United States Patent [19]

Evans et al.

[11] Patent Number: 4,588,391

[45] Date of Patent: May 13, 1986

[54] TRANSFER SYSTEM FOR USE IN CARTON FORMING AND FILLING MACHINERY

[75] Inventors: James W. Evans; John P. Scheid; Daniel R. Eichinger, all of Cedar Rapids, Iowa

[73] Assignee: Cherry-Burrell Corporation, Cedar Rapids, Iowa

[21] Appl. No.: 661,585

[22] Filed: Oct. 17, 1984

[51] Int. Cl.[4] ..... F16H 7/20

[52] U.S. Cl. ..... 493/165; 53/565; 198/429; 493/182

[58] Field of Search ..... 493/123, 164, 165, 180, 493/182, 183, 184, 147, 133; 53/565, 575, 579; 198/428, 429, 430; 414/223

[56] References Cited

U.S. PATENT DOCUMENTS

| | | | |
|---|---|---|---|
| 1,883,369 | 10/1932 | Hardman | 198/429 |
| 3,486,423 | 12/1969 | Mistarz | 493/164 |
| 4,456,118 | 6/1984 | Kauffman et al. | 493/182 |

*Primary Examiner*—Lowell A. Larson

*Assistant Examiner*—Robert Showalter

*Attorney, Agent, or Firm*—Fitch, Even, Tabin & Flannery

[57] ABSTRACT

A transfer system for use in machinery having stations for forming, filling and sealing cartons. The transfer system includes a turret having a hub and a number of spaced radial mandrels received by carton blanks, for use in forming the carton. A main conveyor conveys formed cartons to filling and sealing stations of the machinery. The transfer system includes a transfer conveyor, disposed between the turret and the main conveyor, which receives formed cartons one at a time, from the turret and holds at least one of the formed cartons in alignment with the main conveyor. The transfer system also includes mechanisms for stripping cartons, one at a time, from the mandrels and for transferring a plurality of cartons simultaneously to the main conveyor. A method of transferring cartons from an indexing turret to an indexing main conveyor using an indexing transfer conveyor, is also disclosed.

8 Claims, 9 Drawing Figures

TRANSFER SYSTEM FOR USE IN CARTON FORMING AND FILLING MACHINERY

The present invention relates to a transfer system and, more particularly, to such a transfer system which moves a carton from a turret to a conveyor having an indexing rate no greater than one half that of the turret.

BACKGROUND OF THE INVENTION

Heretofore machinery for automatically forming, filling and sealing cartons for packaging, for example, milk, included a transfer mechanism for moving formed cartons, one at a time, from a carton-forming turret to a conveyor which advanced the cartons through filling and carton top sealing stations. This transfer was carried out while both the turret and the conveyor were in the dwell portion of their cycles. It is always desirable to increase production rates, however, this was impractical to achieve by simply increasing the indexing rate of this long conveyor because the increased number of stop and starts could cause spilling or foaming of the product, increased synchronization requirements for other interfacing components of the machinery, and would increase wear and tear on the long, expensive conveyor likely resulting in excessive maintenance and premature replacement.

In order to increase the output of the machinery without increasing the indexing rate of the conveyor, it has been proposed to double the turret indexing rate while maintaining the conveyor indexing rate. One carton is moved to the conveyor from a transfer system which receives a carton during each dwell period of the turret, while the conveyor is stopped in dwell. The next carton is pushed by the transfer system into the conveyor "on the fly" during the index portion of the conveyor's cycle of operation. It will be appreciated that there are difficulties inherent in attempting to move a somewhat delicate item, such as a thin wall formed paperboard carton into a moving conveyor. Additionally, since the transfer system must be positioned beneath the turret and at the end of the conveyor, the turret cannot be positioned in its usual vertically overlapping relationship with the conveyor. Thus, the use of this prior art transfer system tends to elongate the machinery.

For further information regarding the structure and operation of such prior art carton forming, filling and sealing machinery, reference may be made to U.S. Pat. Nos. 3,486,423 and 4,456,118.

SUMMARY OF THE INVENTION

Among the several objects of the present invention may be noted the provision of an improved transfer system for carton forming, filling and sealing machinery. The transfer system of the present invention effects increased output of the machinery without increasing the indexing rate of the main conveyor by moving two cartons to the main conveyor during each of the conveyor's dwell cycles. Furthermore, "on the fly" loading problems are avoiding because cartons are transferred to the conveyor only when it is stopped (in dwell). Also the new transfer system permits the turret to remain in substantially vertically overlapping relationship with the conveyor. Additionally, the transfer system of the present invention is reliable in use, has long service life and is simple and economical to manufacture. Other objects and features of the present invention will be, in part, apparent and, in part, pointed out hereinafter in the following specification and the accompanying claims and drawings.

Briefly, the transfer system of the present invention is for use with machinery that includes a turret, having a plurality of mandrels receiving carton blanks, for use in forming the bottom closure of the cartons. The machinery also includes a main conveyor for conveying formed cartons to filling, closing and sealing stations. The transfer system includes a transfer conveyor disposed vertically between the turret and the main conveyor which receives formed cartons from the turret and positions them in alignment with the main conveyor. A stripper mechanism moves cartons from the mandrels to the transfer conveyor, and a separate puller mechanism moves cartons from the transfer conveyor to the main conveyor. The transfer system also includes a controller to coordinate and simultaneously move one carton to the transfer conveyor and two cartons therefrom to the main conveyor.

As a method of transferring cartons, the present invention includes several steps:

a. The turret and conveyors are indexed in synchronization with the main conveyor being indexed at a rate one half that of the turret and transfer conveyor.

b. A carton is moved from the turret to the transfer conveyor when they are in dwell and the main conveyor is not.

c. A carton is also moved to the transfer conveyor and two cartons are moved to the main conveyor when the main conveyor is in dwell.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
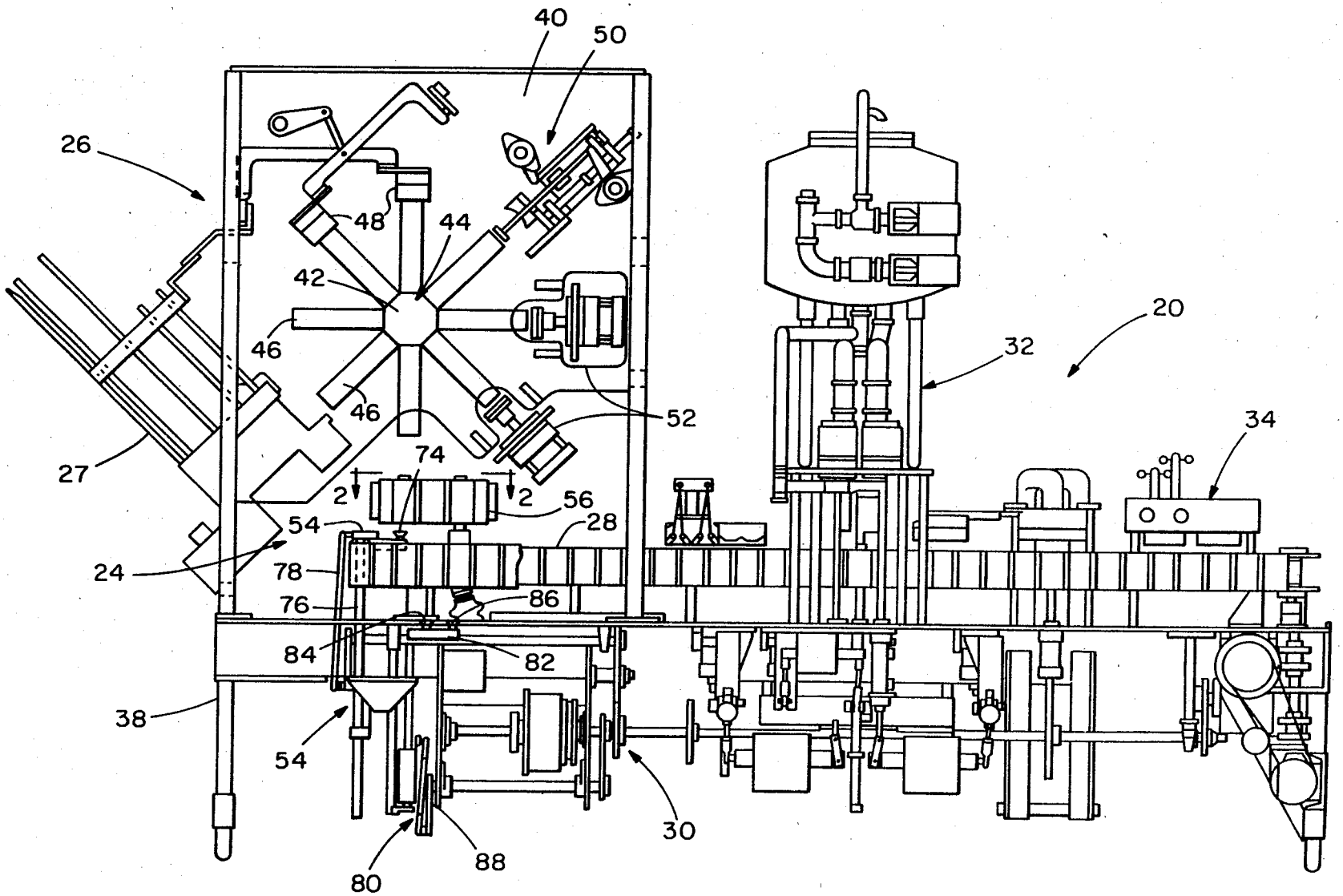
FIG. 1 is a side elevational view of machinery for performing operations on cartons, incorporating one preferred embodiment of the transfer system of the present invention.

Referring now to the drawings, one preferred embodiment of an improved transfer system of the present invention for use in machinery 20 for forming, filling and sealing cartons 22 is generally indicated in FIG. 1 by reference numeral 24. The machinery 20 includes a forming station 26, including a magazine 27 for holding a stack of carton blanks 22A (shown in FIG. 3) which forms the carton blanks 22A into four-sided tubes and closes and seals their bottoms. The machinery also includes a main conveyor 28 which receives the thus-formed cartons and is indexed by a drive system (shown in block form in FIG. 4) to advance the cartons to a filling station 32 and a carton top closing station 34. More specifically, the main conveyor advances the cartons by sliding them on a support rail 35. Components of the forming station and the main conveyor, drive system, and the filling, closing and sealing stations are of the type fully shown and described in U.S. Pat. No. 3,486,423, the teachings of which are hereby incorporated by reference, except that a bottom-up fill is employed.

Figure 3:
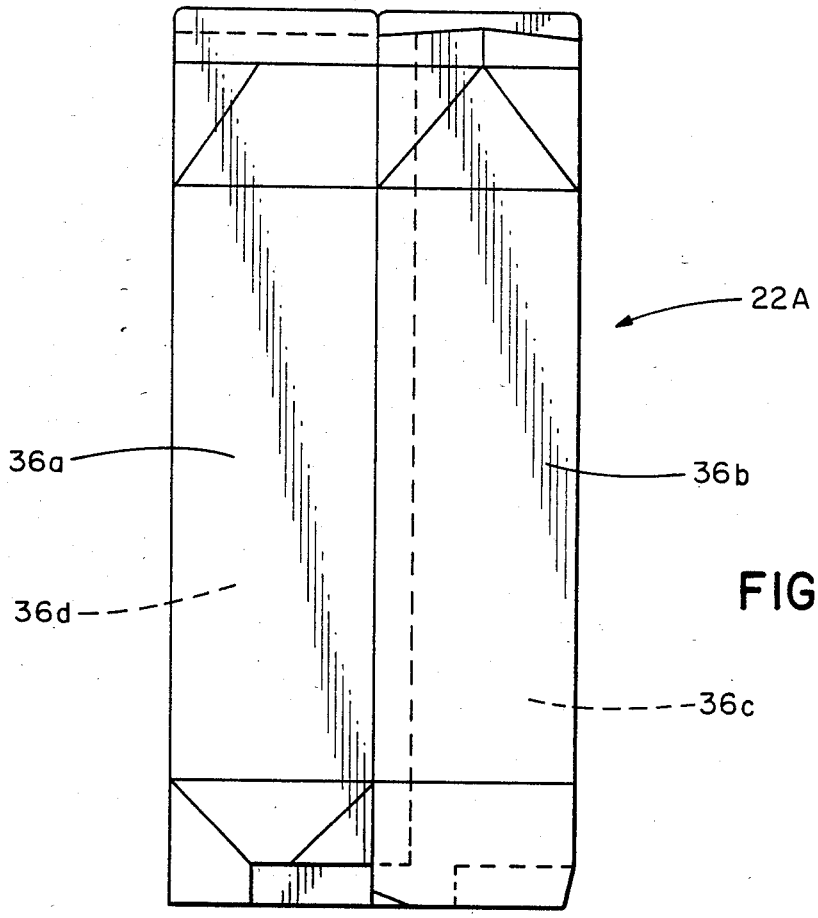
FIG. 3 is a plan view of a carton blank which the machinery of FIG. 1 forms into a carton, fills and closes.

Referring to FIG. 3, the carton blanks 22A, which are formed into the well known four-sided tube with a gable roof which can be opened to form a pouring spout, are themselves formed from a paperboard blank having overlapping ends adhered together to define a tube. The blanks 22A are held in the magazine in flattened form and include side panels 36*a*, 36*b*, 36*c* (substantially identical to panel 36*a* and disposed under panel 36*b*) and 36*d* (substantially identical to panel 36*b* and disposed under panel 36*a*). The construction and formation of such carton blanks into cartons is well known to those of skill in the art and need not be detailed here. Suffice it to say that each panel has an elongated intermediate portion, a lower portion with score lines and an upper portion with score lines. The intermediate portions define a four-sided tube for receiving the product. The lower extensions are adapted to be formed and sealed into a flat bottom. And the upper extensions are formed and sealed into a gable roof which, preferably, can be opened and manipulated by the user to function as a pouring spout.

Referring to FIG. 1, the machinery 20 includes a main frame 38 for supporting components of the drive system, main conveyor and filling and closing stations. Attached to the frame is a vertical support wall 40 which rotatably carries the hub 42 of a turret 44 having eight regularly spaced radial mandrels 46. The turret 44, which is disposed in vertically overlapping relationship with the carton-receiving end of the main conveyor 28, is driven by the main drive 90 through a controller 94 (FIG. 4) which indexes it through a number of carton forming substations. More specifically, and analogizing the substation positions to a clock face, at 7:30 a mandrel 46 receives a carton blank from the magazine 27 which includes a mechanism for opening the leading carton blank into a tube and pushing it onto the mandrel. Ovens 48 are provided at 10:30 and 12:00 for heating a thermoplastic coating carried by the lower portions of the carton blank panels 36. When the reference mandrel 46 is indexed to 1:30, a bottom former 50 breaks the lower panel portions along their score lines and folds them to form a flat bottom. Bottom sealers 52 are disposed at 3:00 and 4:30, and they function to fully form the bottom of the carton after the ovens have heated the closure parts to a temperature sufficient to activate the adhesive characteristic of the thermoplastic coating. Each sealer includes a pressure pad which advances toward the flat distal surface of the aligned mandrel to compress the carton bottom components therebetween. Finally, when the reference mandrel is indexed to the 6:00 position, it is properly aligned for a stripper mechanism 54 (discussed below) to remove the formed carton.

Figure 2:
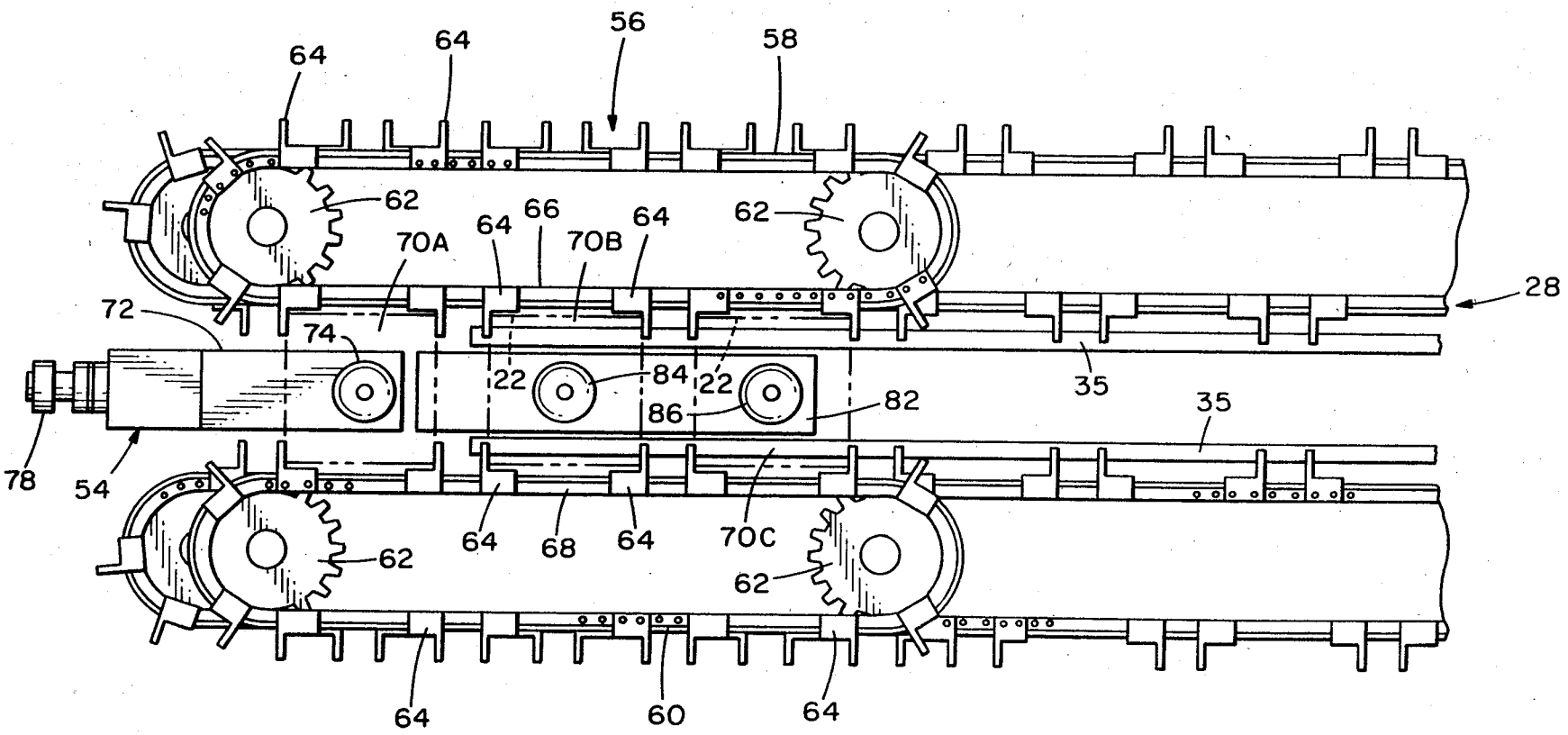
FIG. 2 is a sectional view taken generally along line 2—2 of FIG. 1 illustrating aligned carton-receiving pockets of a transfer conveyor and a main conveyor, and components which move cartons to the transfer conveyor and therefrom to the main conveyor.

The transfer system 24 of the present invention, besides including the turret 44, also includes an intermediate or transfer conveyor 56 supported between the turret and the main conveyor 28. The transfer conveyor, best shown in FIG. 2, like the main conveyor 28, comprises a pair of endless chain assemblies 58, 60 arranged in horizontal parallel relationship. The chain assemblies are supported and driven by spaced sprocket wheels 62 which are in turn indexed by the drive system 30. Each chain assembly carries a series of spaced, outwardly extending lugs 64. The lugs are arranged on the assemblies so that in the facing adjacent parallel linear run portions 66, 68 of the respective assemblies (which define an open centered conveyor) corresponding lugs of each assembly are aligned and form pairs. Two adjacent pairs of the lugs define an operative carton-receiving pocket 70, and the transfer conveyor 56 has at least three operative pockets 70A, 70B, 70C. The lugs are positioned to frictionally support the cartons against the force of gravity.

The transfer system 24 also includes the stripper mechanism 54 for moving formed cartons, one at a time, from a mandrel in the 6:00 position, and a transfer mechanism for moving cartons, two at a time, from the transfer conveyor 56 to the main conveyor 28. The stripper includes a stripper mechanism 54 comprising a horizontally disposed plate 72 carrying on its upper surface a suction cup 74 aligned with pocket 70A. The plate 72 also has a dependent guide rod 76 slidably supported to limit plate 72 so that cup 74 reciprocates only in the vertical direction. A cranking mechanism 78 interconnects the plate and the drive system 30 to move the suction cup against the bottom of the carton on the reference mandrel at the 6:00 position and pull the carton into the conveyor pocket 70A. It will be appreciated that a vacuum line and attendant controller (not shown) are provided to apply a vacuum to the cup when it is desired to strip the carton from the mandrel, and to exhaust the cup to atmosphere when the carton is held in pocket 70A. It is noted that such a stripper mechanism is fully discussed in the incorporated-by-reference U.S. Pat. No. 3,486,423.

Also included is a transfer or puller mechanism 80 generally similar in construction and operation to the stripper mechanism except it functions to move two cartons from transfer conveyor pockets 70B and 70C to aligned pockets of the main conveyor 28 when both conveyors are in dwell. The puller mechanism includes a horizontally disposed plate 82, limited to vertical reciprocation, carrying spaced suction cups 84, 86 aligned with transfer conveyor pockets 70B, 70C, respectively. A cranking mechanism 88 interconnects the plate 82 and the drive system 30 to lift the cups 84, 86 to their respective cartons in the transfer conveyor and pull the plate and the cartons downwardly to corresponding pockets in the main conveyor while both conveyors are in dwell.

Figure 4:
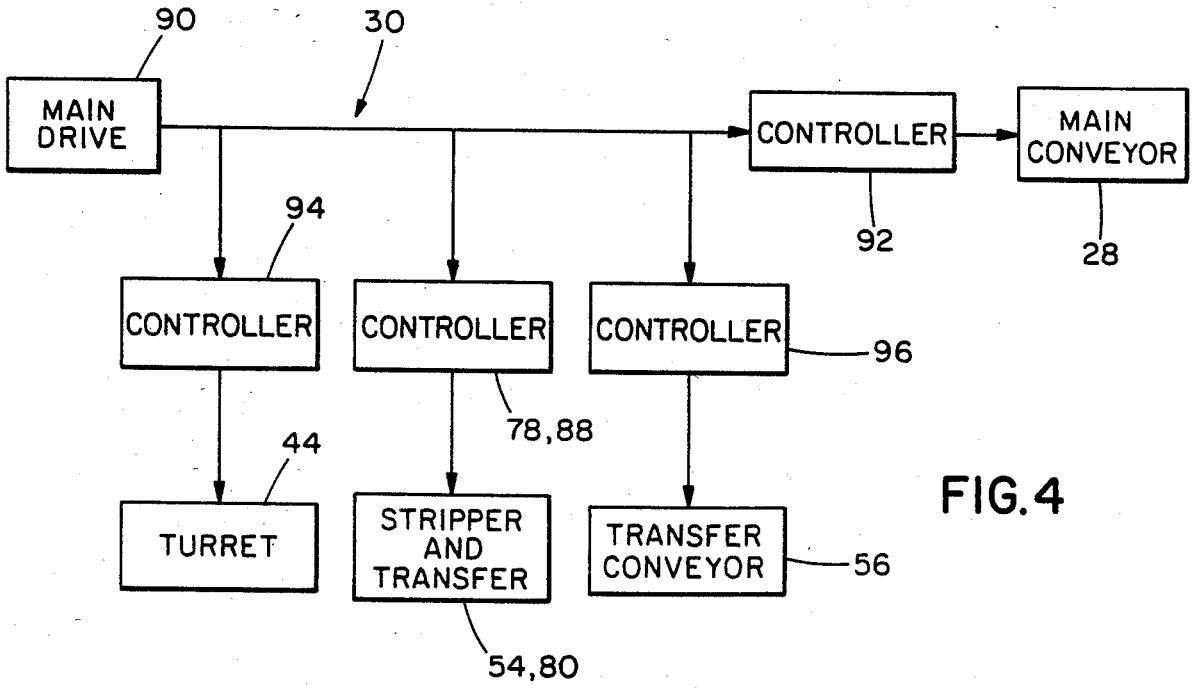
FIG. 4 is a block diagram of a drive system for the transfer system of FIG. 1.

A block diagram of the portion of drive system 30 of the machinery 20, relating to the transfer system 24 is shown in FIG. 4. As in U.S. Pat. No. 3,486,423, power for various components of the machinery is provided by a single drive train powered by a main drive motor 90. As in that patent, an intermittent drive controller 92 drives the sprocket wheels of the main conveyor and another intermittent drive controller 94 indexes the turret. However, in the transfer system of the present invention, the turret has an index rate twice that of the main conveyor. The transfer conveyor is driven through an intermittent drive controller 96 at the same index rate and in synchronization with the turret. Of course, the operation of the stripper and transfer mechanisms 54, 80 is controlled by their respective cranking mechanism 78, 88.

Figure 5:
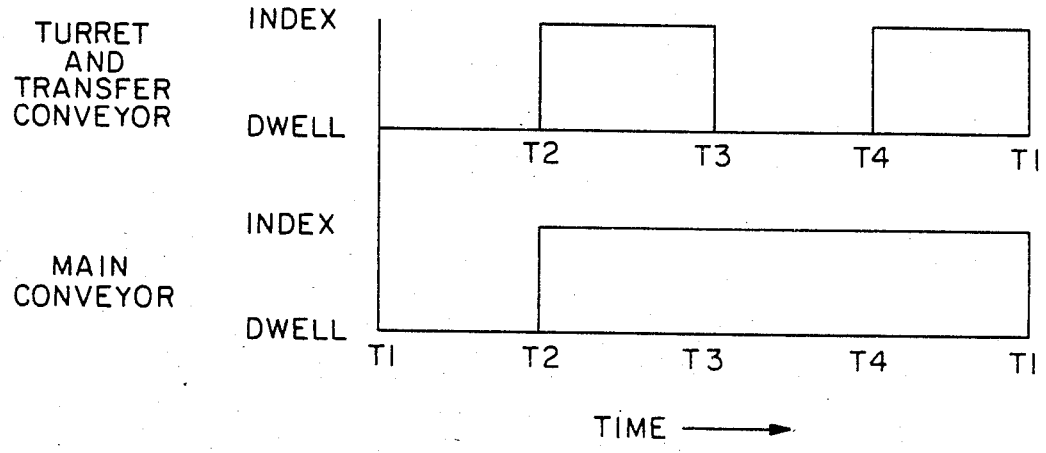
FIG. 5 is a timing diagram illustrating the relative operational cycles of various components of the transfer system; and FIGS. *6a–6d* schematically depict the various steps in the operation of the transfer system of FIG. 1.
Figure 6A:
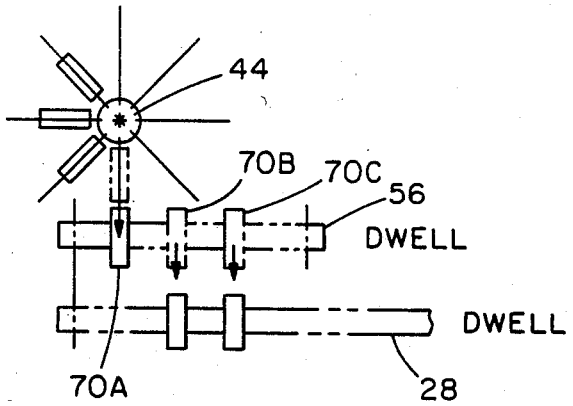
Figure 6B:
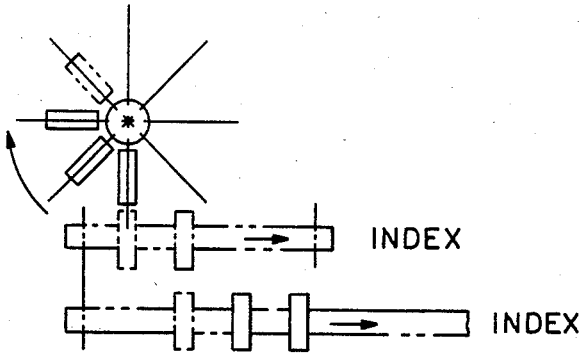
Figure 6C:
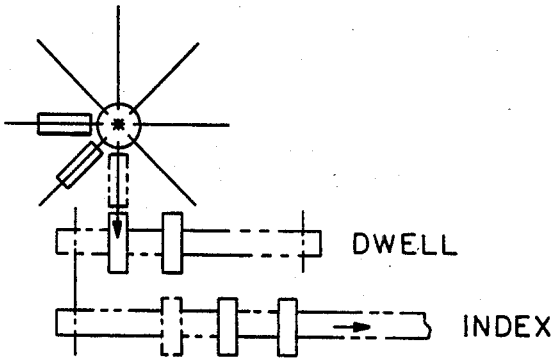
Figure 6D:
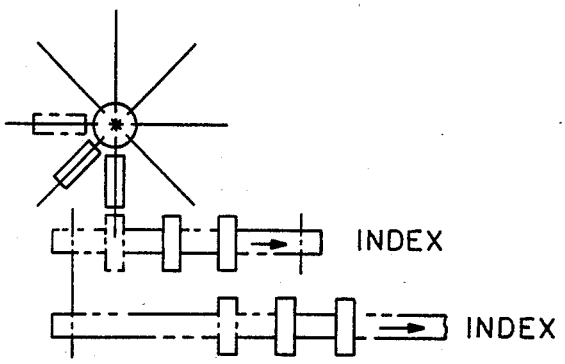

Operation of the transfer system 24 is as follows: Referring to the timing diagram of FIG. 5 and the schematic diagram of the steps in the operation of the transfer system shown in FIGS. *6a–6d*, in FIG. *6a* at time T1 the turret, the transfer conveyor and the main conveyor are all in the dwell portions of their operational cycles. During this time the stripper mechanism 54 advances a carton from the mandrel which is in the 6:00 position to the transfer conveyor and the transfer mechanism 80 pulls two cartons from the transfer conveyor to the main conveyor. At time T2 of the timing diagram, both the transfer conveyor and the main conveyor along with the turret are all indexed as shown in FIG. *6b*. During this indexing the carton which was loaded into pocket 70A advances to pocket 70B. At time T3 as shown in FIG. *6c*, the turret and the transfer conveyor enter the dwell portions of their cycles and the stripper mechanism 54 moves a formed carton from the next mandrel, now at the 6:00 position, into the transfer conveyor where it is compressively held. It is noted that the main conveyor is still in the index portion of its cycle. At time T4 as shown in FIG. *6d*, the turret and transfer conveyor again index which causes the carton loaded into pocket 70A as well as the carton previously loaded and now at 70B, to move to pockets 70B and 70C, respectively. At the completion of the cycle, at time T1, the transfer mechanism 80 again moves the cartons from transfer conveyor pockets 70B and 70C into corresponding aligned pockets of the main conveyor and at the same time the stripper mechanism 54 moves a carton from the mandrel now at the 6:00 position to the transfer conveyor.

It will thus be appreciated that the transfer system of the present invention permits a doubling of the production rate while maintaining the indexing rate of the main conveyor. This avoids increasing the production rate by increasing the index rate of the main conveyor which could, over time, increase the maintenance requirement for the main conveyor and possibly result in its premature replacement. Additionally, since additional starts and stops of the main conveyor are not required, there is less likelihood of spilling or foaming of the product due to the increased instances of acceleration and deceleration. The transfer system of the present invention also avoids the difficult step of placing a carton in the main conveyor "on the fly".

While the transfer system of the present invention has been described with reference to a two to one transfer arrangement, it will also be appreciated that the transfer conveyor could be equipped with four pockets, the index rate of the turret and transfer conveyor set at three times that of the main conveyor and that three cartons could be transferred from the transfer conveyor to the main conveyor while one carton is moved from turret to the transfer conveyor. Additionally, it is contemplated that the transfer system could be arranged whereby there is a two to one arrangement but during the dwell of the main conveyor the associated transfer mechanism moves one carton from the transfer conveyor and one carton from the mandrel at the 6:00 position directly to the main conveyor. In this arrangement the transfer mechanism would move a carton from the turret to the transfer conveyor during the dwell of the transfer conveyor while the main conveyor is still in the index portion of its cycle of operation.

As a method of transferring cartons from an indexing turret having radial mandrels, to an indexing main conveyor using an indexing transfer conveyor, the present invention includes the following steps:

1. The turret and conveyors are indexed in synchronous with the main conveyor being indexed at one half the rate of the turret and transfer conveyor.

2. A carton is moved from the turret to the transfer conveyor while they are in dwell and the main conveyor is indexing.

3. A carton is moved to the transfer conveyor and two cartons are moved to the main conveyor when the main conveyor is in dwell.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A transfer system for use in machinery having stations for forming, filling and sealing cartons including a turret having a hub and a plurality of spaced radial mandrels received by carton blanks, for use in forming said cartons; and a main conveyor for conveying formed cartons to filling and sealing stations of said machinery; said transfer system comprising:

a transfer conveyor movable in the same direction as said main conveyor and disposed below said turret and above said main conveyor and aligned with both said turret and said main conveyor receiving formed cartons, one at a time, from said turret and holding at least one of said formed cartons in alignment with said main conveyor; and means stripping cartons, one at a time, from said mandrels and transferring a plurality of cartons simultaneously by moving them downwardly to said main conveyor, said transfer system further comprising a first indexing means indexing said turret, a second indexing means indexing said transfer conveyor at an indexing rate identical to that of said turret, and a third indexing means indexing said main conveyor at an indexing rate no greater than one half that of said turret, said stripping and transferring means including a stripper mechanism moving a carton from one of said mandrels to said transfer conveyor during each dwell period of said transfer conveyor, said stripping and transferring means further including a transfer mechanism moving a plurality of cartons from said transfer conveyor to said main conveyor during each dwell period of said main conveyor.

2. A transfer system as set forth in claim 1 wherein said transfer conveyor comprises a pair of endless chain assemblies driven by sprocket wheels and arranged in parallel relationship, each of assemblies carrying a series of spaced lugs with corresponding lugs from each assembly being aligned, said lugs defining carton-receiving pockets.

3. A transfer system as set forth in claim 2 wherein said chain assemblies define at least three operative pockets.

4. A transfer system as set forth in claim 3 wherein said lugs are spaced to compressively hold the cartons against the force of gravity.

5. A transfer system as set forth in claim 1 wherein said turret includes eight regularly spaced mandrels and the transfer conveyor index rate is twice the main conveyor index rate.

6. A transfer system as set forth in claim 5 wherein said turret is positioned at the machinery forming station, said forming station having a number of substations including two heating substations and two bottom sealing substations.

7. A transfer system for use in machinery having stations for forming, filling and sealing cartons including a turret having a plurality of mandrels receiving carton blanks, for use in forming said cartons, and a main conveyor for conveying formed cartons to filling and sealing stations of said machinery; said transfer system comprising:

a transfer conveyor movable in the same direction as said main conveyor and disposed below said turret and above said main conveyor and aligned with both said turret and said main conveyor receiving formed cartons from said turret and holding cartons in alignment with said main conveyor;

means stripping cartons from said mandrels and delivering said stripped cartons to said transfer conveyor and moving cartons from said transfer conveyor to said main conveyor; and means controlling said first-mentioned means to simultaneously move one carton to said transfer conveyor and two cartons to said main conveyor during each dwell period of said main conveyor.

8. A method of transferring cartons from an indexing turret having radial mandrels to an indexing main conveyor using an indexing transfer conveyor movable in the same direction as said main conveyor, said method comprising:

indexing said turret and conveyors in synchronization, with said main conveyor being indexed at on half the rate of the turret and transfer conveyor;

moving a carton downwardly from the turret to the transfer conveyor when they are in dwell and the main conveyor is indexing; and moving a carton downwardly from the turret to the transfer conveyor and moving two cartons downwardly to the main conveyor when the main conveyor is in dwell.

* * * * *